US005189392A

United States Patent [19]

Kass et al.

[11] Patent Number: 5,189,392

[45] Date of Patent: Feb. 23, 1993

[54] HEATING SYSTEM SHUT-OFF SYSTEM USING DETECTOR AND EXISTING SAFETY SWITCH OR FUEL VALVE

[76] Inventors: Carl E. Kass, P.O. Box 346, Cragsmoor, N.Y. 12420; Arthur W. Little, R.R. Box 91, Napanoch, N.Y. 12458

[21] Appl. No.: 719,636

[22] Filed: Jun. 24, 1991

[51] Int. Cl.[5] ..... G08B 19/00

[52] U.S. Cl. ..... 340/521; 340/500; 340/532; 340/632; 251/129.04

[58] Field of Search ..... 340/521, 500, 501, 632, 340/532; 251/89, 90, 93, 129.04

[56] References Cited

U.S. PATENT DOCUMENTS

| | | | |
|---|---|---|---|
| 3,665,399 | 5/1972 | Zehr et al. | 340/501 |
| 4,668,940 | 5/1987 | Beard et al. | 340/500 |
| 4,788,529 | 11/1988 | Lin | 340/500 |
| 5,003,162 | 3/1991 | Townsend et al. | 340/500 |

*Primary Examiner*—Donnie L. Crosland
*Attorney, Agent, or Firm*—Jay H. Maioli

[57] ABSTRACT

A safety apparatus for shutting off a unit having a manually operated power interruption switch upon detecting a predetermined condition. In addition, to power interruption a fluid fuel supply to a combustion unit having a manually operated interruption valve arranged in the line is also interrupted.

9 Claims, 4 Drawing Sheets

HEATING SYSTEM SHUT-OFF SYSTEM USING DETECTOR AND EXISTING SAFETY SWITCH OR FUEL VALVE

BACKGROUND OF THE INVENTION

1. Field of the Invention

This invention relates generally to a safety system for a home heating system or hot-water heater and, more particularly, to such safety system using a smoke detector and the existing power interruption switch of the heating system.

2. Description of the Background

One of the common hazards associated with the burning of fuel for the heating of a home or the heating of water used in the home is that the smoke and combustion gasses resulting from such burning are not properly and safely vented to outside the home. This improper venting may be caused by many things, including the blocking of the chimney by animals or birds; the obstruction of the smoke passages within a heating system or boiler due to the accumulation of carbon and other combustion particles, which is especially true in newer, high-efficiency units with smaller passages; the disconnection of the heating system or boiler from the chimney due to the improper connection or repeated vibration of the connecting piping; and fire leaking from the boiler or heating system due to damage, or failure of the boiler or heating system.

There are many hazards associated with improperly vented smoke and combustion gasses, such as asphyxiation of the occupants of the structure by carbon monoxide and other combustion gasses, and the sooty accumulation of smoke within the house and on the contents. Also, if the smoke is the result of fire leakage, there is the chance that the leaking fire will eventually cause the structure to burn.

Almost all home heating systems, and many domestic water heaters, have a safety switch, usually located at the head of the basement stairway, so that the homeowner can interrupt the power to the heating system in case of an emergency. Typically, the homeowner or emergency worker smells smoke or notes some other malfunction and throws the switch, thereby interrupting the electrical supply to the heating system. This power interruption then shuts down the entire heating system, that is, in the case of a gas or oil-fired heating system the supply of fuel to the combustion element is ultimately interrupted and the heating system stops functioning.

Of course, the use of residential smoke detectors has become widespread and the benefits of these devices are well known. Typically, when using a smoke detector, the occupant hears and/or sees the alarm and, in the case of a heating system problem, turns off the heating system using the safety shut-off switch, as described above.

A system that can interrupt the power to an electric range and that employs a smoke or flame detector has previously been described in U.S. Pat. No. 4,659,909. This system is wired into the power connection to the electric range, which typically does not have a safety shut-off switch of the kind provided for a heating system.

These existing systems have all been found to have one or more drawbacks affecting their safety, performance, and convenience. For example, in the case of the conventional smoke alarm, the occupant must manually throw the safety switch. If a problem occurs when no one is home the safety system can, of course, not be activated. In the case of the electric range shut offs, a 120/240 volts power supply line is used to trip a circuit breaker switch.

OBJECTS AND SUMMARY OF THE INVENTION

Accordingly, it is an object of the present invention to provide a safety shut-off system for a heating system or hot-water heater that can eliminate the above-noted defects inherent in previously known systems.

It is another object of the present invention to provide a system to sense the presence of smoke, combustion gasses, or heat in the environment surrounding the heating system and to cause the heating system to stop producing the smoke and combustion gasses by interrupting power and/or fuel to the heating system.

A still further subject of the present invention is to provide a safety apparatus for controlling heating systems by means of detecting an environmental condition and automatically shutting down the system via the interruption of the electricity powering the system or the interruption of the fuel flowing to the system by mechanically operating an existing power interruption safety switch or fuel line valve.

According to an aspect of the present invention a safety apparatus for shutting off a combustion unit having a manually operated interruption switch comprises an environmental condition sensor that is arranged proximate the unit for sensing a selected condition. Once the environmental condition sensing means detects the desired condition it produces a low-voltage, low-amperage output signal indicative thereof, and control unit receives the output signal and produces a low-voltage, low-amperage energization signal. This low-voltage energization signal is sent to an electrically operated actuator that mechanically operates an existing interruption switch of the unit, thereby interrupting the flow of fuel or power or both to the combustion unit.

According to another aspect, the invention also provides a safety apparatus for shutting off a fluid fuel supply line to the combustion unit having a manually operated interruption valve arranged therein. Once the environmental condition sensor senses the selected condition and the control unit in turn produces the low-voltage energization signal, an electrically operated actuating means, which is mounted on the interruption valve, is energized and mechanically operates the interruption valve. This electrically operated actuating means mechanically causes the interruption valve to be turned to a closed position.

The above and other objects, features, and advantages of the present invention will become apparent from the following detailed description of illustrative embodiments thereof to be read in conjunction with the accompanying drawings, in which like numerals represent the same or similar elements.

DETAILED DESCRIPTION OF PREFERRED EMBODIMENTS

Figure 1:
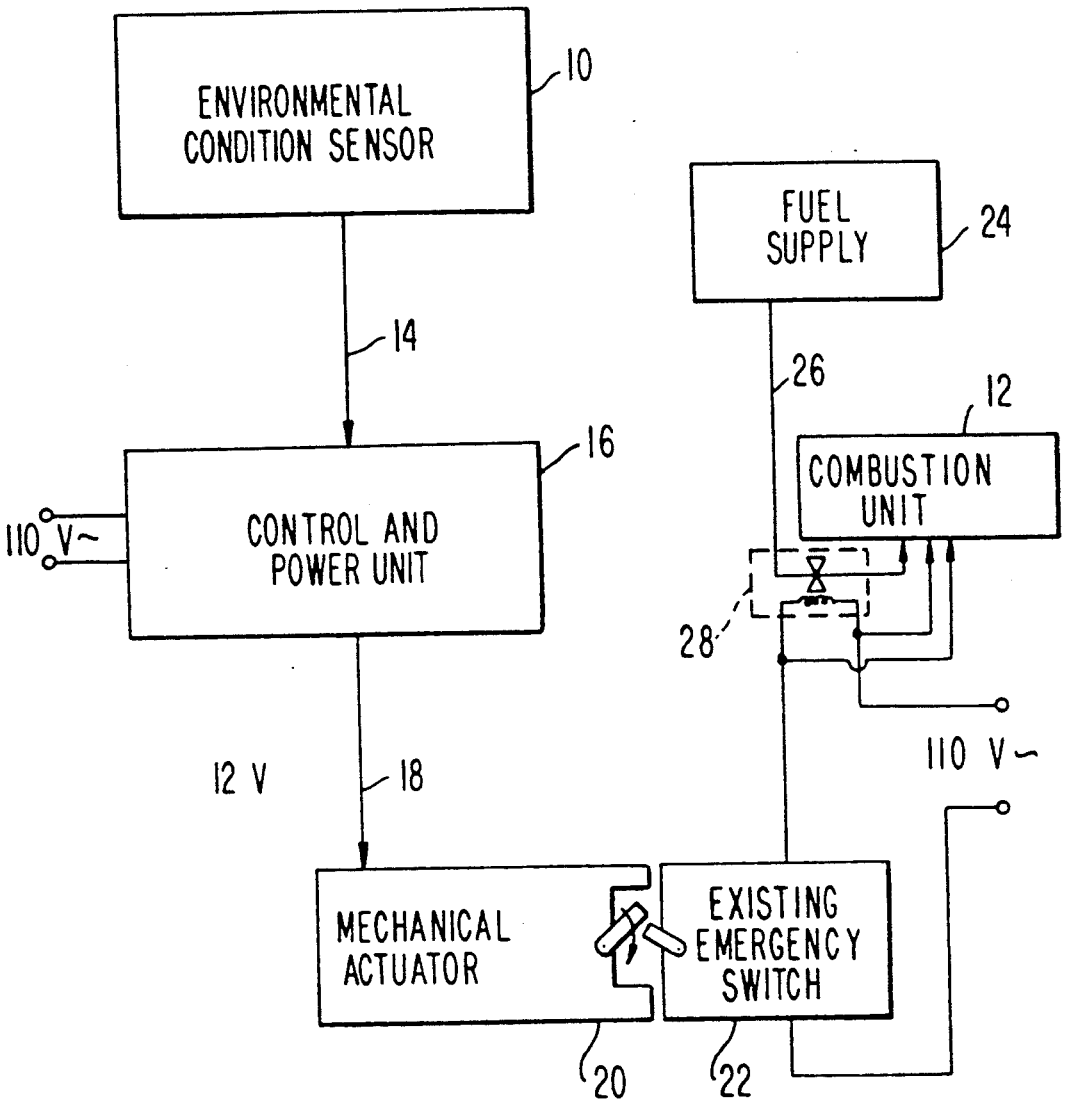
FIG. 1 is a block diagram of a safety shut-off apparatus for activating an emergency cutoff switch of a unit according to an embodiment of the present invention.

FIG. 1 shows a safety apparatus for shutting off a combustion unit of the kind typically having a manually operated interruption switch. An environmental condition sensor 10 is mounted in the vicinity of a combustion unit 12 for sensing a selected condition. Upon environmental condition sensor 10 detecting the specific condition being monitored, an output signal indicative thereof is fed on line 14 to a control unit 16. Control unit 16 is connected to the available house current and may comprise an internal relay and a transformer, so that the transformer produces a low voltage when the sensor 10 senses the condition of interest. This low-voltage energization signal is fed on line 18 to an electrically operated actuator 20 that mechanically operates the existing interruption switch 22 of the unit 12 causing the interruption switch to be opened and thus shutting off the unit.

By providing a low-voltage fed to actuator 20, the present invention contemplates installation by the homeowner. Thus, control unit 16 is plugged into an existing outlet without requiring special wiring and the low-voltage wire is simply run to actuator 20. No house current wiring is involved, nor special Underwriters Laboratories approval for the circuitry is required.

More specifically, combustion unit 12 has a fuel supply 24 and a supply line 26 that is connected to combustion unit 12 by a solenoid valve, shown by dashed lines 28. Normally, the emergency switch 22 is in the electrical circuit of solenoid 28 so that upon opening the emergency switch 22 the fuel supply is interrupted.

Fluid fuel includes, but is not limited to, flowing gases, liquids or solids, examples of which are, natural gas, propane, kerosene, fuel oil, and combustible pulverized solid matter.

In the operation of the embodiment of FIG. 1 a smoke detector forms the environmental condition sensor 10, which is wired to control unit 16. When control unit 16 receives a low-voltage, low-amperage signal on line 14 from the smoke detector 10 it produces a low-voltage energization signal on line 18 fed to mechanical actuator 20. When the signal appears on line 18, actuator 20 causes a lever to pivot and turn off the existing emergency shutoff switch 22 for combustion unit 12.

Figure 2:
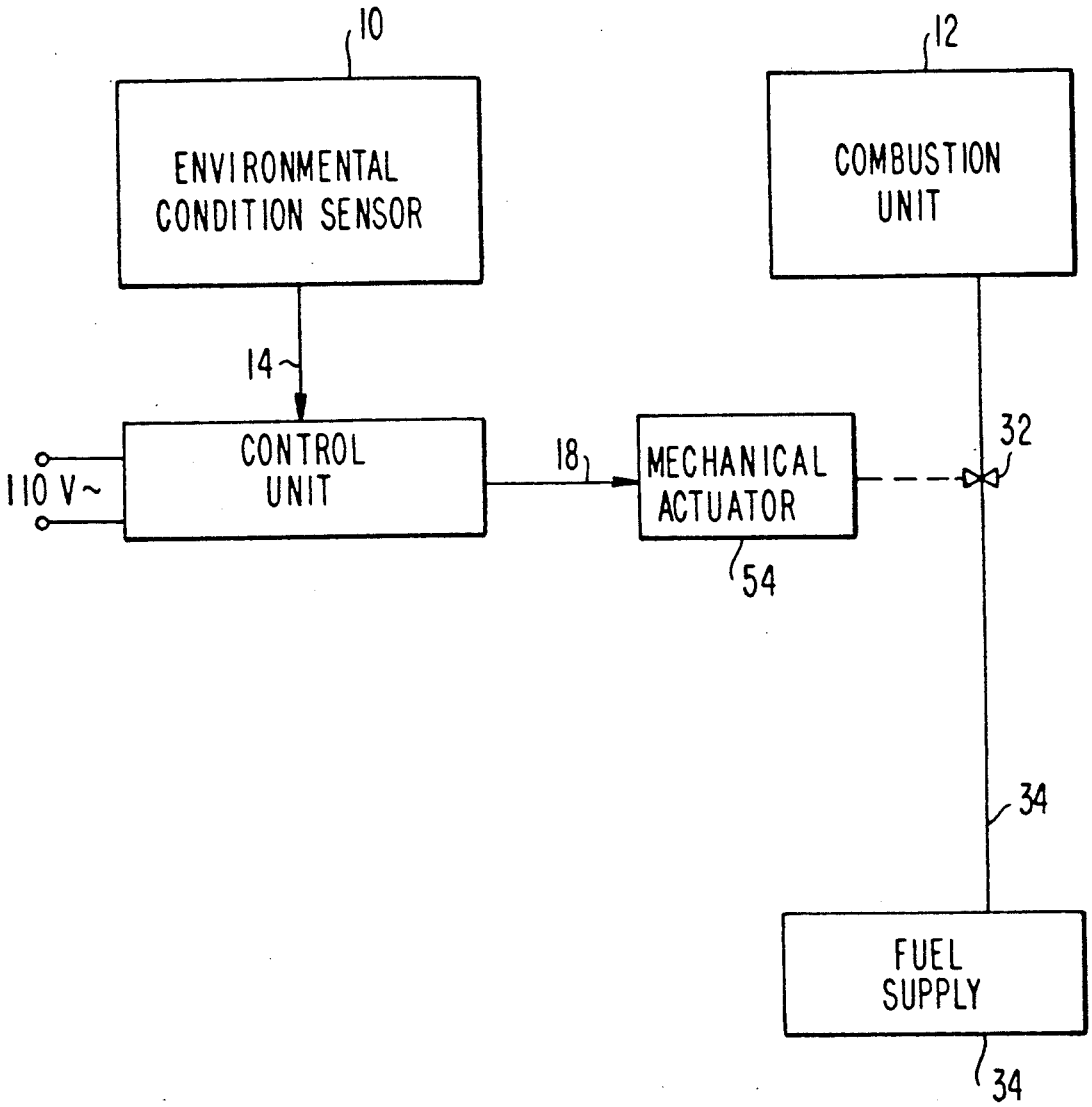
FIG. 2 is a block diagram of a safety shut-off apparatus for a fluid fuel line.

FIG. 2 shows a safety apparatus for shutting off a fluid fuel line to a combustion unit having a manually operated interruption valve already provided. An environmental condition sensor 10 is mounted in the vicinity of combustion unit 12 for sensing a selected condition. Upon environmental condition sensor 10 detecting the specific condition being monitored, a low-voltage, low-amperage output signal indicative thereof is fed on line 14 to control unit 16. Control unit 16 is connected to the available house current and may comprise an internal relay and a transformer, so that the transformer produces a low-voltage when the sensor 10 senses the condition of interest. This low-voltage energization signal is fed on line 18 to an electrically operated valve actuator 54 that mechanically operates the existing fuel interruption valve 32 upon receiving the low-voltage energization signal. This electrically operated actuating means mechanically causes the interruption valve to be turned to a closed position, thus stopping the flow of the fuel from supply 34. The fuel supply 34 is fluid fuel which includes, but is not limited to, flowing gases, liquids or solids, examples of which are, natural gas, propane, kerosene, fuel oil, and combustible pulverized solid matter.

By producing a low-voltage fed to the mechanical actuator 54, the present invention contemplates installation by the homeowner. The control unit 16 can be plugged into an existing outlet without requiring any special wiring, and there is only a low-voltage wire run to the mechanical actuator 54. No wiring involving high voltage is required, thus making installation easier and safer.

Figure 3:
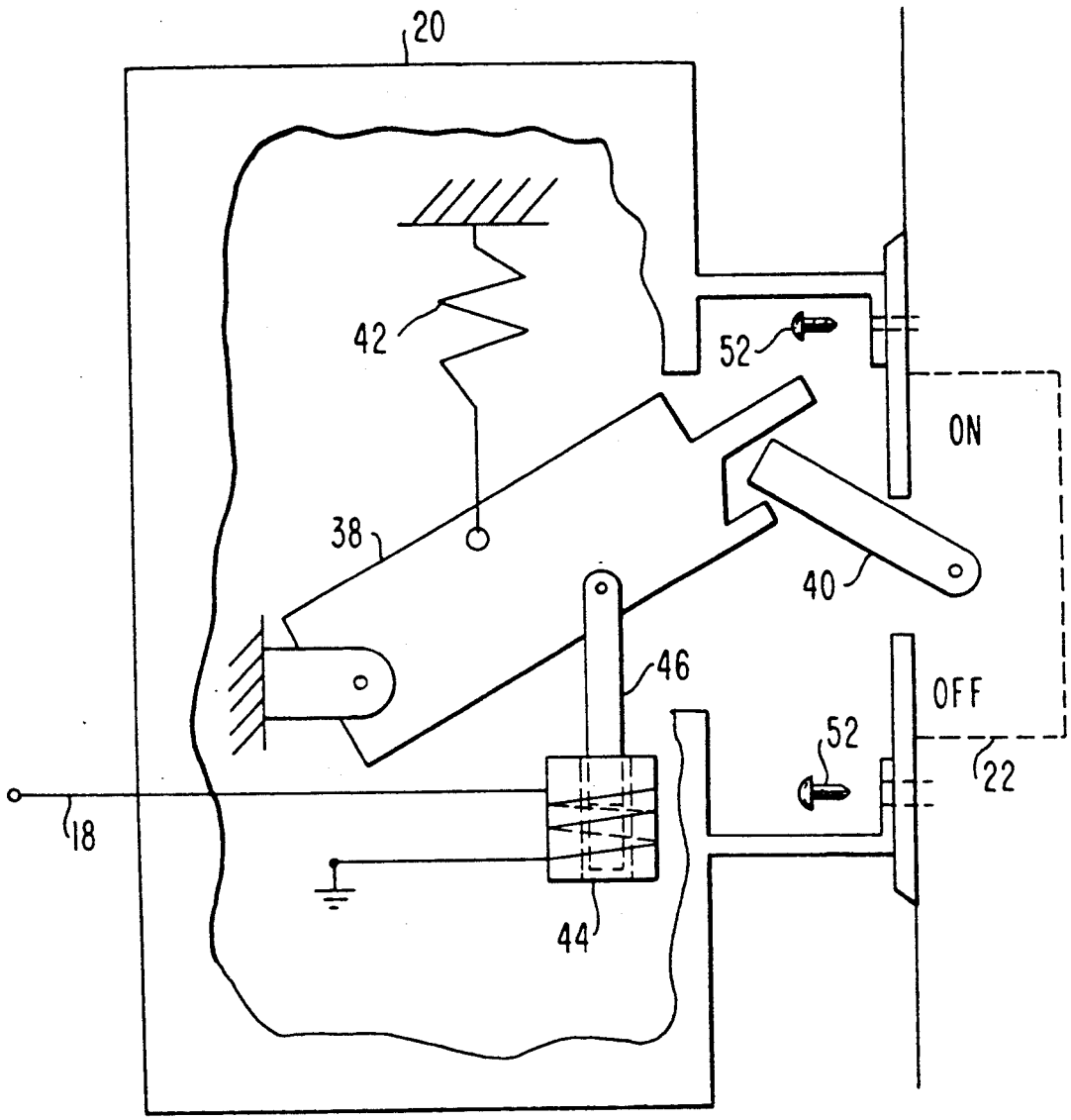
FIG. 3 is a diagrammatic representation of an embodiment of the mechanical actuator used in the apparatus of FIG. 1.

FIG. 3 shows a diagrammatic representation of one possible embodiment of the mechanical actuator used to turn off the existing emergency switch. The mechanical actuator 20 is attached over the existing emergency switch 22, for example, by screws 52 attaching through the existing holes of the switch plate into the existing screw holes of the switch in such a way that the mechanical lever 38 of the actuator 20 couples with the toggle arm 40 of switch 22. In the resting state the mechanical lever 38 is secured in the on position by a tension spring 42. Line 18 is connected to the winding of the coil of a solenoid 44, so that upon receiving the low-voltage energization signal from control unit 16 a magnetic field is generated. This field draws an iron rod 46 down into it, thereby pulling the mechanical lever 38 down and thus causing the existing emergency switch lever 40 to be turned off. The existing emergency switch 22 can still be manually actuated, even with the present invention installed, by means of external lever 53 attached to mechanical lever 38. The internal snap action mechanism (not shown) of switch 22 is sufficient to overcome the tension of spring 42.

Figure 4:
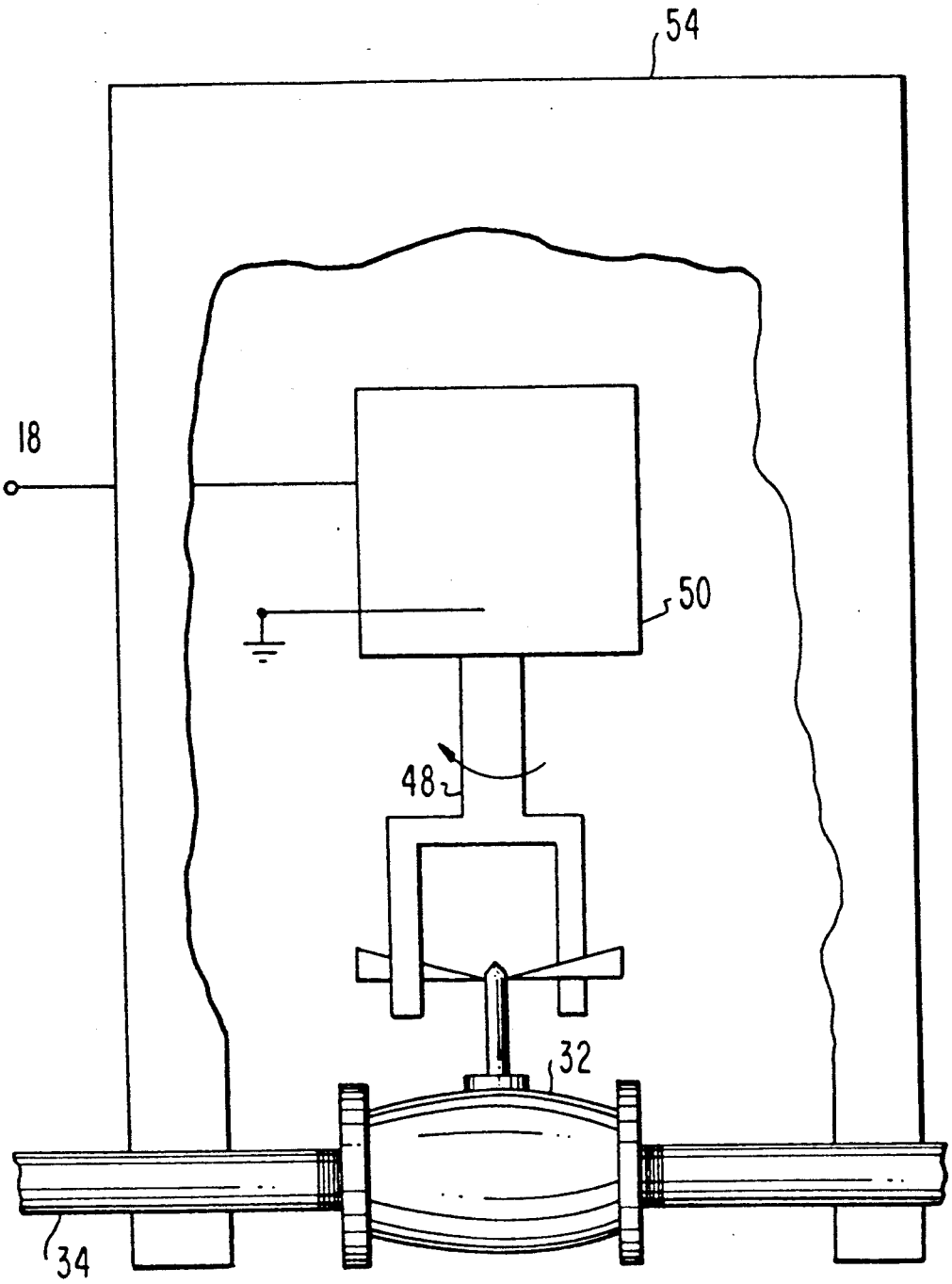
FIG. 4 is a diagrammatic representation of an embodiment of the mechanical actuator used in the apparatus of FIG. 2.

FIG. 4 shows a diagrammatic representation of one possible embodiment of the mechanical actuator used in the embodiment of FIG. 2 to turn the existing fuel line valve off. The mechanical actuator 54 rests over the existing fuel line valve 32 in such a way that the end of a rotating shaft 48 couples with the valve handle 56. Upon receiving a low-voltage energization signal on line 18 a low speed motor 50 is activated to turn through an internal gear set, the shaft 48 in such a way to turn handle 56 to cause the existing fuel line valve 32 to shut off, stopping the flow of fuel in the fuel line 34.

An environmental condition sensing means may include, but need not be limited to, a smoke detector, heat detector, flame detector, or gas detector. Several environmental condition sensing means may be used at one time to provide more accurate detection of a desired condition in a given area. One can also simultaneously employ several different types of environmental condition sensing means to ensure protection from a variety of possible conditions.

The invention additionally provides an environmental condition sensing means which gives an audible alarm in addition to sending an output signal indicative of the condition to the control means.

Because there are no high voltage lines, the invention can be safely installed by the typical homeowner with the aid of common household tools.

The above description is presented by way of example only, but it will be apparent that many modifications and variations could be affected by one skilled in the art without departing from the spirit of the invention, which is to be defined by the appended claims.

What is claimed is:

1. A safety apparatus for shutting off a unit having a manually operated interruption switch, comprising:

environmental condition sensing means arranged proximate the unit for sensing a selected condition and producing a low-voltage, low amperage, output signal indicative thereof;

control means receiving said output signal from said environmental condition sensing means and producing a low-voltage, low-amperage, energization signal;

electrically operated actuating means connected to receive said energization signal from said control means for operating said interruption switch; and mounting means for mounting said electrically operated actuating means adjacent said manually operated interruption switch, whereby said interruption switch is mechanically operated by said actuating means to an open condition and the unit is shut off upon said actuating means receiving said energization signal from said control means.

2. A safety apparatus for shutting off a fluid fuel line to a unit having a manually operated interruption valve arranged therein, comprising:

environmental condition sensing means arranged proximate the unit for sensing a selected condition and producing an output signal indicative thereof;

control means receiving said output signal from said environmental condition sensing means and producing a low-voltage energization signal;

electrically operated actuating means connected to receive said energization signal from said control means for operating said interruption valve; and mounting means for mounting said electrically operated actuating means on the interruption valve, so that upon said actuating means receiving said low-voltage energization signal from said control means said interruption valve is turned to a closed position by said actuating means.

3. A safety apparatus of claim 1 or 2 wherein the environmental condition sensing means is a smoke detector.

4. A safety apparatus of claim 1 or 2 wherein the environmental condition sensing means is a heat detector.

5. A safety apparatus of claim 1 or 2 wherein the environmental condition sensing means is a gas detector.

6. A safety apparatus of claim 1 or 2 wherein the environmental condition sensing means is a flame detector.

7. A safety apparatus of claim 1 or 2 wherein the environmental condition sensing means is a rate of heat rise detector.

8. A safety apparatus of claim 1 or 2 wherein the output signal of the environmental condition sensing means causes an audible signal to be produced.

9. A safety apparatus of claim 1 or 2 wherein a plurality of environmental condition sensing means are employed.

* * * * *